US005848170A

United States Patent [19]

Mahieux et al.

[11] Patent Number: 5,848,170

[45] Date of Patent: Dec. 8, 1998

[54] ACOUSTIC ANTENNA FOR COMPUTER WORKSTATION

[75] Inventors: Yannick Mahieux, Tonquedec; Grégoire Le Tourneur, Saint-Quay-Perros; Alain Saliou, Lannion, all of France

[73] Assignee: France Telecom, France

[21] Appl. No.: 770,120

[22] Filed: Dec. 18, 1996

[30] Foreign Application Priority Data

Dec. 22, 1995 [FR] France ..... 95 15387

[51] Int. Cl.[6] ..... H04R 3/00

[52] U.S. Cl. ..... 381/92; 381/365; 381/91

[58] Field of Search ..... 381/92, 91, 122, 381/169

[56] References Cited

U.S. PATENT DOCUMENTS

| | | |
|---|---|---|
| 2,810,786 | 10/1957 | Spandock et al. . |
| 4,559,642 | 12/1985 | Miyaji et al. . |
| 4,578,543 | 3/1986 | LeBourlot et al. . |
| 4,703,506 | 10/1987 | Sakamoto et al. . |
| 5,657,393 | 8/1997 | Crow ..... 381/92 |

FOREIGN PATENT DOCUMENTS

| | | |
|---|---|---|
| 0 082 529 | 6/1983 | European Pat. Off. . |
| 0 381 498 | 8/1990 | European Pat. Off. . |
| 2 722 637 | 1/1996 | France . |
| 33 30 698 | 3/1984 | Germany . |
| 2 100 551 | 12/1982 | United Kingdom . |
| 95/01078 | 1/1995 | WIPO . |
| 95/31805 | 11/1995 | WIPO . |

OTHER PUBLICATIONS

Patent Abstracts of Japan; vol. 5, No. 27 (E–046), 18 Feb. 1981 & JP–A–55 151897 (Matsushita), 26 Nov. 1980;  abstract .

*Primary Examiner*—Forester W. Isen
*Attorney, Agent, or Firm*—Larson & Taylor

[57] ABSTRACT

An acoustic antenna for computer workstation, used for video conferencing that comprises a plurality of microphones connected to a summator circuit. The microphones are distributed in a layout so as to form a substantially straight line and are each spaced with respect to a reference microphone placed in the vicinity of the vertical axis of symmetry of the screen of the workstation according to a specified law. The layout exhibits a substantially cylindrical directivity pattern whose axis of revolution is formed by the straight line.

9 Claims, 9 Drawing Sheets

Figure 1:
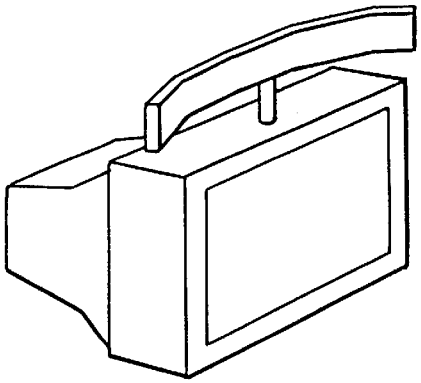
FIG.1.( PRIOR ART )

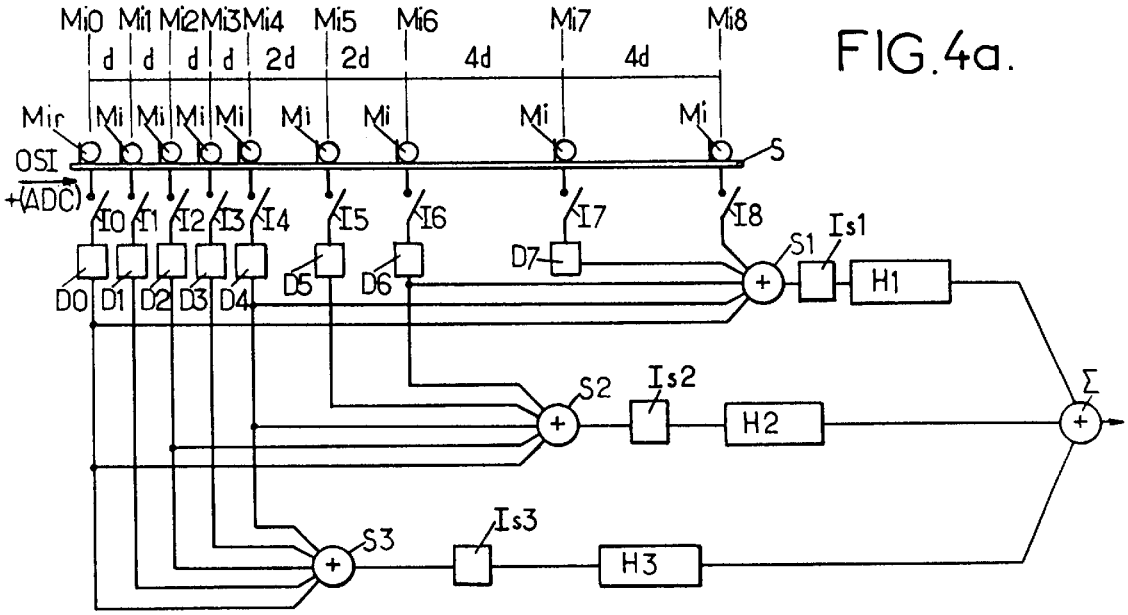
FIG.4a.
FIG.4b.
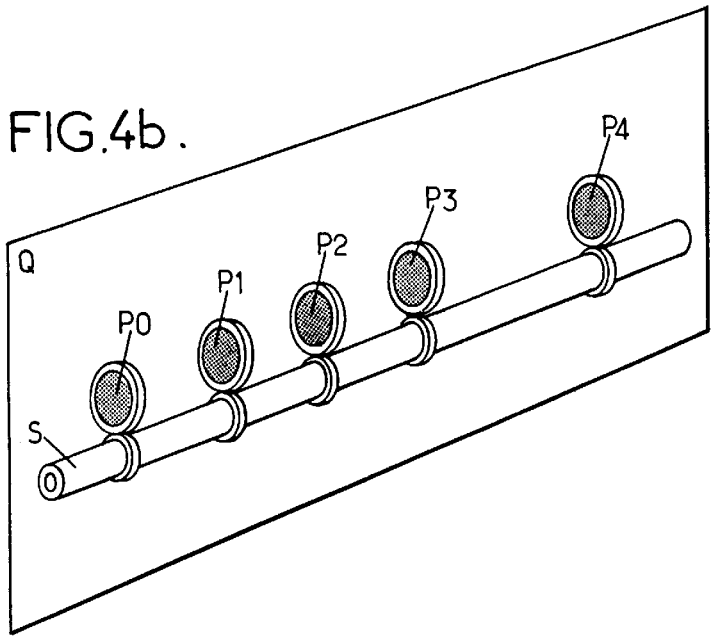

FIG. 4c.
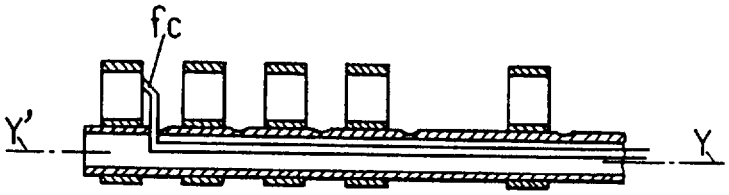
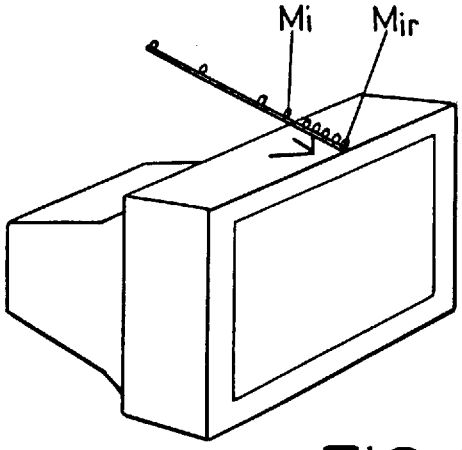
FIG. 4d

ACOUSTIC ANTENNA FOR COMPUTER WORKSTATION

The invention relates to an acoustic antenna for computer workstation.

Currently, the use of computer workstations is set to expand, both as regards single-facility workstations and multi-facility workstations connected in a network.

In any event, the workstation is tending to become a communication interface between the user and the machine, or the workstation, or even between each user, when the workstations are connected in a network. In particular, in the latter case, a particularly interesting application of these workstations relates to video conferencing, in the course of which application several workstations and obviously their users can communicate by way of messages conveyed by audio and video links.

So as to cause minimum disturbance to the working environment of each user of the aforesaid workstations, it is essential that each workstation allow its user to communicate via video and audio messages independently, in particular, of the position of the user, the talker, in relation to the relevant workstation, or even, more generally, when several workstations are brought together in the same meeting room, within the framework of a multiple video conferencing meeting, independently of the environmental context thus created, as well as noise generated by the fans of these workstations, external noise from air conditioning or the like, as well as the acoustic echo generated by the loudspeakers of these workstations.

Conventional computer workstations currently available on the market, even though these stations are equipped with so-called "multimedia" processing means such as in particular microphones and loudspeakers, digitizing audio cards and video cards to the MPEG standard, cannot lay claim to carry out such functions.

More recent work has been carried out in order to implement computer workstations equipped with high-performance acoustic antennas, enabling the aforesaid functions to be carried out. The solutions adopted, for example according to French patent application no. 94 08809, filed on 15.07.1994 in the name of the same inventors, introduced into the present text by way of reference, allowed the implementation of computer workstations equipped with an acoustic antenna of "cylindrical" type. This type of acoustic antenna in fact comprises an aerial consisting of a plurality of microphones distributed over a concave surface. It exhibits good performance as regards the selectivity and directivity of the capture of sound from the talker, independently of the context of the latter's environment, and of the coupling with the loudspeaker(s). However, the aerial thus constituted exhibiting the form of a concave band placed above the upper face of the video display monitor of the workstation has been deemed to be unaesthetic by users or potential users. Furthermore, the concave band constituting the aforesaid aerial cannot easily be integrated with the terminal of the computer workstation, especially with the casing of its video display monitor, unless significant modifications are provided therefor, these modifications furthermore being liable to modify the globally satisfactory conditions of sound capture.

The aim of the present invention is to remedy the aforesaid drawbacks of the prior art acoustic antennas more particularly intended for computer workstations.

An aim of the present invention is in particular the implementation of an acoustic antenna for computer workstation which preserves properties of satisfactory conditions of sound capture and is able to be integrated without major difficulty into the video display monitor of the workstation for which it is intended.

Another aim of the present invention is also the implementation of an acoustic antenna for computer workstation exhibiting, in addition to the aforesaid satisfactory properties of conditions of sound capture, which, although not easily able to be integrated, exhibits a very discreet and hence aesthetically easily acceptable appearance to users.

The acoustic antenna for computer workstation including a display screen, which is the subject of the present invention, is noteworthy in that it comprises a plurality of microphones connected to a summator circuit, these microphones being distributed in a layout so as to form at least one substantially straight line. The microphones are furthermore each spaced, with respect to a reference microphone placed in the vicinity of the vertical axis of symmetry of the screen according to a specified law, the layout thus exhibiting a substantially cylindrical directivity pattern whose axis of revolution is formed by this straight line.

The acoustic antenna, which is the subject of the present invention, finds application to the implementation of computer workstations, more particularly intended for video conferencing applications.

Figure 2A:
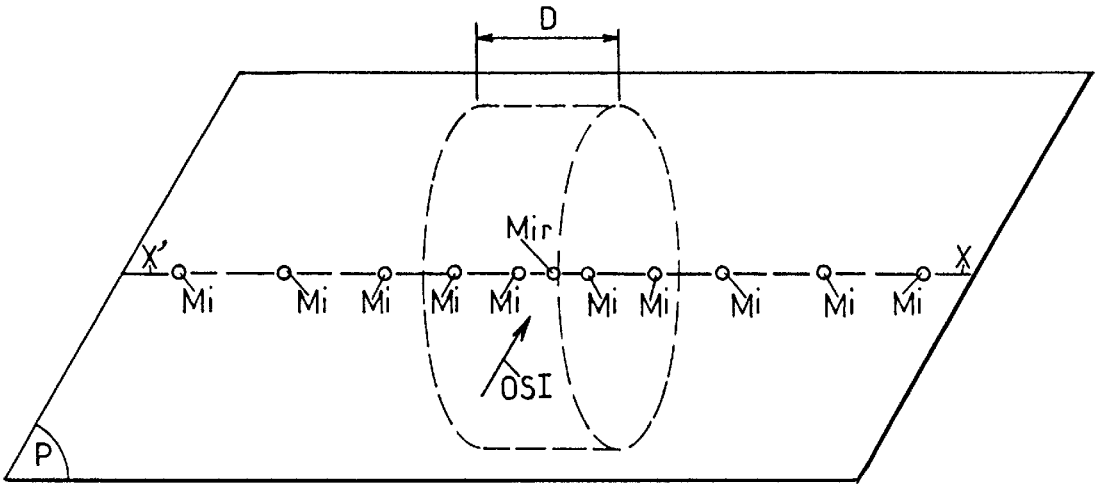
Figure 2B:
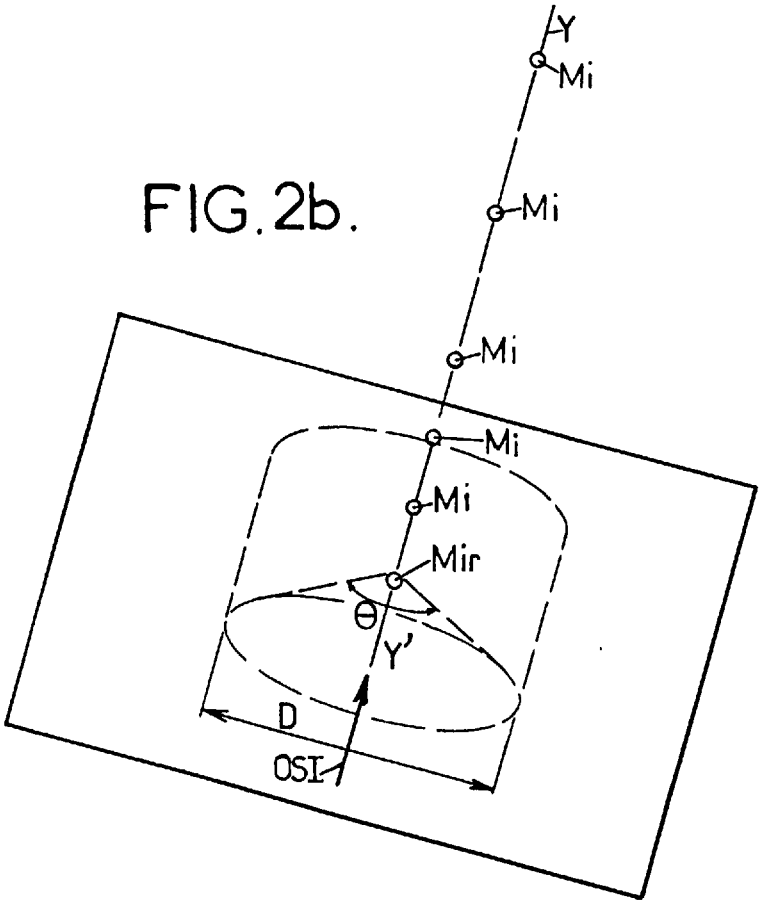
Figure 3A:
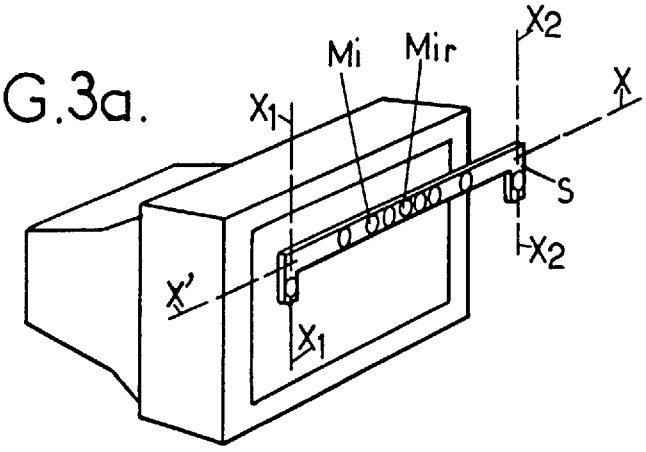

It will be better understood on reading the description and looking at the drawings below, in which, in addition to FIG. 1 relating to the prior art, FIG. 2*a* represents a basic diagram of an acoustic antenna in accordance with the subject of the present invention, of the "broadside" type;

FIG. 2*b* represents a basic diagram of an acoustic antenna in accordance with the subject of the present invention, of the "end-fire" type;

FIG. 3*a* represents a preferred embodiment of an acoustic antenna of the "broadside" type such as represented in FIG. 2*a;*

Figure 3B:
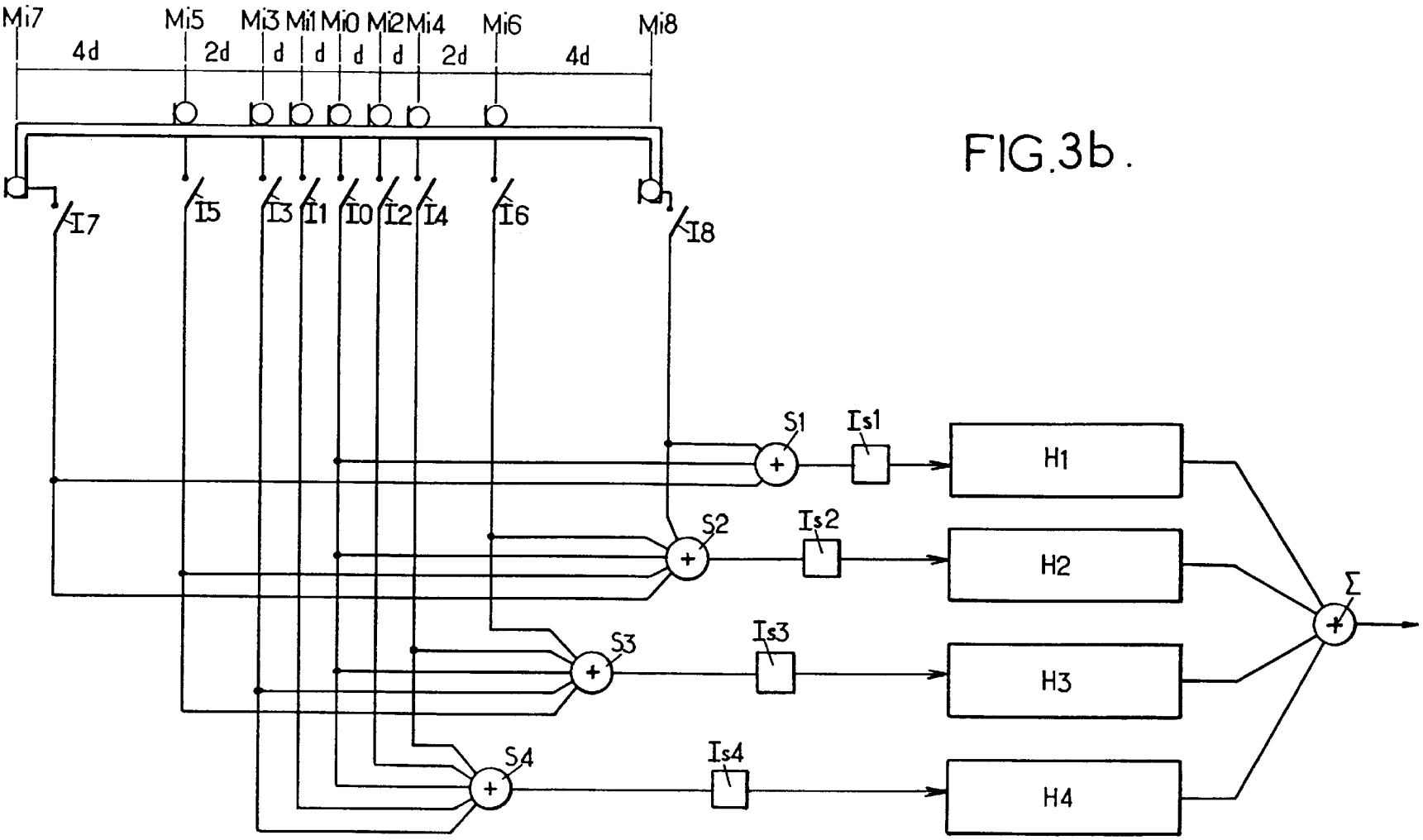

FIG. 3*b* represents a detail of an embodiment of the acoustic antenna of the "broadside" type of FIG. 3*a;*

FIG. 4*a* represents a non-limiting embodiment of an acoustic antenna of the "end-fire" type such as represented in FIG. 2*b;*

FIG. 4*b* represents a structural embodiment of the acoustic antenna such as represented in FIG. 4*a;*

FIG. 4*c* represents a sectional view along a longitudinal plane of symmetry of the acoustic antenna represented in FIG. 4*b;*

FIG. 4*d* represents an acoustic antenna of the "end-fire" type placed on the upper edge of the display monitor of a workstation;

FIGS. 5*a* to 5*d* represent various reception directivity patterns for various acoustic antennas, which are the subject of the present invention.

A more detailed description of the acoustic antenna for computer workstation according to the subject of the present invention will now be given in conjunction with FIGS. 2*a* and 2*b*.

In a general manner, it is indicated that the computer workstation comprises a display monitor or display screen making it possible to carry out the function of support of the acoustic antenna which is the subject of the present invention.

Furthermore, it is indicated that the latter comprises a plurality of microphones, denoted $M_i$, connected to a summator circuit intended, on the basis of an incident sound wave ISW, to deliver a corresponding sound signal. In FIGS. 2*a* and 2*b,* the summator circuit is not represented so as not to overburden the drawing. The microphones $M_i$ are distributed in a layout to form at least one substantially straight line, the line x'x in FIG. 2*a*. The microphones $M_i$ are each spaced with respect to a reference microphone, denoted $M_{ir}$, placed in the vicinity of the vertical axis of symmetry of the screen according to a specified distribution law. It is thus understood that the reference microphone $M_{ir}$ makes it possible, for a symmetric configuration of the distribution of the microphones over the substantially straight line x'x, to produce a configuration which is symmetric with respect to the average position of the uses talker. The layout of aforesaid microphones then exhibits a substantially cylindrical directivity pattern whose axis of revolution is formed by the abovementioned straight line.

In the case of FIG. 2*a,* it is indicated that the acoustic antenna for computer workstation, which is the subject of the present invention, corresponds to an embodiment of the "broadside" type. In such a case, it is indicated that the incident sound wave ISW, emanating from the talker, is then perpendicular to the aforesaid straight line x'x over which the microphones $M_i$ are distributed. The layout of microphones then exhibits a reception directivity pattern which consists of a substantially vertical disc of width D in the azimuth plane P, that is to say in the plane containing the azimuth angle for the reference microphone $M_{ir}$.

In the case of the embodiment of FIG. 2*a,* it is indicated that the thickness of the disc thus formed in fact corresponds to the width of the main lobe of the reception directivity pattern of the antenna thus constituted. In such a case, it is indicated that the thickness D of the aforesaid disc is, at a given frequency, inversely proportional to the length of the antenna, that is to say ultimately to the number of microphones $M_i$ and to their spacing with respect to the reference microphone $M_{ir}$.

In the case of the embodiment of FIG. 2*b,* this embodiment corresponding to an acoustic antenna of the "end-fire" type, the substantially straight line bears the reference y'y, this line being substantially parallel to the average direction of propagation of the incident sound wave ISW. In such a case, the layout of microphones exhibits, with respect to the reference microphone $M_{ir}$, a likewise substantially cylindrical reception directivity pattern, the axis of revolution being formed by the aforesaid straight line. In this case however, the incident sound wave ISW parallel to the direction of the substantially straight line y'y, sees on the contrary a more extended reception directivity pattern insofar as the dimension D relating to the aperture of the reception directivity pattern corresponds substantially to the diameter of the substantially cylindrical directivity pattern, the angle of aperture θ of the main lobe being of the order of 80°. In this case also, the reference microphone $M_{ir}$ is of course placed in the vicinity of the vertical axis of symmetry of the screen and the successive microphones $M_i$ are placed on the straight line y'y substantially in the vertical plane of symmetry of the aforesaid screen of the corresponding computer workstation.

A more detailed description of the embodiment relating to FIG. 2*a* corresponding to a "broadside" antenna will now be given in conjunction with FIG. 3*a*.

In the embodiment of FIG. 3*a,* it is indicated that the acoustic antenna according to the invention comprises, in order to realize the layout of microphones, a plurality of microphones $M_i$ distributed over a first substantially horizontal line and placed at the upper part of the screen and at least one microphone placed on a second and a third line $x_1x'_1$ and $x_2x'_2$ respectively, the second and the third line being placed perpendicularly to the ends of the first line x'x. In accordance with a particularly advantageous aspect of the acoustic antenna, which is the subject of the present invention, the microphones of the first, second and third lines are arranged in a plane.

Preferably, as represented also in FIG. 3*a,* the microphones $M_i$ are arranged on an antenna support made for example from plastic, this antenna support and the corresponding microphones $M_i$ being arranged in the upper part of the filter of the display screen, as represented in FIG. 3*a*. The antenna support and the microphones can also be placed on the screen itself or on the video monitor comprising this screen. More particularly, it is indicated that the microphone support can be made from a plastic strip whose height is of the order of a few centimeters, 4 to 5 cm, in the direction orthogonal to the direction of propagation of the incident sound wave ISW. The microphones $M_i$ are thus anchored in the support strip and are thus placed 2 or 3 cm in front of the screen proper. Such a layout has proven to be satisfactory from the acoustic point of view insofar as such a placement of the microphones does not disturb sound capture of the incident sound wave ISW. It is indicated that, conventionally, the microphones $M_i$ and the reference microphone $M_{ir}$ are grouped together by interconnection as elementary sub-antennas.

Represented in FIG. 3*b* is a detail of an embodiment of the antenna of the "broadside" type of FIG. 3*a,* in particular the subdivision of the latter into sub-antennas. The microphones, denoted $M_{i0}$ to $M_{i8}$, are by way of non-limiting example of the unidirectional type. They are distributed symmetrically with respect to the central microphone $M_{i0}$, in fact constituting the reference microphone $M_{ir}$. The symmetrical distribution extends over the support in the direction x'x orthogonal to the direction of the incident sound wave ISW. Each microphone is linked to a common summator Σ by way of filters, denoted $H_1$ to $H_4$ by way of elementary summators, denoted $S_1$ to $S_4$, each elementary summator $S_1$ to $S_4$ in fact defining a sub-antenna.

In the example embodiment of FIG. 3*b,*

- the reference microphone $M_{i0}$ is connected to the four elementary summators $S_1$ to $S_4$;
- the microphones $M_{i3}$, $M_{i4}$, respectively adjacent to the preceding microphones $M_{i1}$, $M_{i2}$, to the elementary summators $S_4$, $S_3$;
- the successive microphones $M_{i5}$, $M_{i6}$, respectively adjacent to the preceding microphones $M_{i3}$, $M_{i4}$, to the elementary summators $S_3$, $S_2$;
- the successive microphones $M_{i7}$, $M_{i8}$ respectively adjacent to the preceding microphones $M_{i5}$, $M_{i6}$ to the elementary summators $S_1$ and $S_2$.

The connection of each microphone to the aforesaid elementary summators can advantageously be carried out by way of corresponding switches, denoted $I_0$ to $I_8$, and each elementary summator $S_1$ to $S_4$ can be connected to the common summator Σ by way of a filter $H_1$ to $H_4$ a d a switch in series $IS_1$ to $IS_4$. The law spatially distributing the microphones symmetrically with respect to the reference microphone $M_{i0}$, along the direction x'x, is of the form:

$$x=k.d.$$

In this relation, k is a relative integer, d represents an arbitrary distance related to the cutoff frequency of the filters $H_1$ to $H_4$, x represents the algebraic value of the abscissa of each microphone with respect to the reference microphone $M_{ir}$, the microphone $M_{i0}$.

In a preferred embodiment, d=2.13 cm, the abscissae of the 9 microphones installed on the support S were as follows:

| Mi7 | Mi5 | Mi3 | Mi1 | Mi0 | Mi2 | Mi4 | Mi6 | Mi8 |
|---|---|---|---|---|---|---|---|---|
| −8d | −4d | −2d | −d | 0 | d | 2d | 4d | 8d |
| −17.04 cm | −8.52 cm | −2.13 cm | −2.13 cm | 0 | 2.13 cm | 4.26 cm | 8.52 cm | 17.04 cm |

It is then indicated that the value of the distance d is chosen as a function of the value of the cutoff frequency of the filters $H_1$ to $H_4$.

The "broadside" antenna embodiment according to FIGS. 2*a* and 3*a,* 3*b* appears particularly interesting insofar as, whereas it allows entirely satisfactory conditions of sound capture, the integration of the corresponding acoustic antenna does not pose major difficulty.

Of course, and so as to raise the rate of rejection of environmental noise and room effect, especially with a view to the application to video conferencing workstations, in the case of the embodiment according to FIG. 2*a* of the acoustic antenna, which is the subject of the present invention, this embodiment corresponding to an antenna of the "broadside" type, the only solution which can be envisaged in practice in order to increase the aforesaid rate of rejection, is to reduce the thickness D of the disc, that is to say the aperture dimension of the main lobe of the reception directivity pattern, by increasing the number of microphones $M_i$ and the dimensions of the antenna thus produced.

However, increasing the dimensions and the number of microphones cannot be envisaged beyond a certain limit, especially by virtue of the difficulties of integrating an antenna which had dimensions which were too large with respect to the dimensions of the display monitor. Furthermore, when the thickness D of the disc, aperture dimension of the main lobe, decreases beyond a certain value, the least displacement of the talker with respect to the plane of symmetry of the reference microphone $M_{ir}$ and ultimately of the plane of symmetry of the display screen, has the effect of causing a very large reduction in the speech signal transmitted since the talker is then outside the area of maximum sensitivity of the main lobe of the reception directivity pattern.

For this reason, and in accordance with a same aspect of the acoustic antenna, which is the subject of the present invention, a second embodiment, of the "end-fire" type, has been developed, this embodiment corresponding to the acoustic antenna as described in conjunction with FIG. 2*b*.

In general, it is indicated that the acoustic antenna represented in FIG. 2*b* is akin to the microphones known as rifle microphones. Furthermore, through the correct play of delays applied to the elementary speech signals delivered by each microphone $M_i$ and by the reference microphone $M_{ir}$, the sound waves emitted by the talker, the incident sound wave ISW being directly in alignment with the microphones in the aforesaid case, are in fact favoured.

Given the configuration of the microphones and the delays afforded, the reception directivity pattern is, as represented in FIG. 2*b,* formed by substantially a cylinder whose base is oriented towards the talker.

Rejection of environmental noise and room effect is substantially identical for the same number of microphones to that obtained with the acoustic antenna of the "broadside" type. However, the angle of aperture of the main lobe is much greater, of the order of 80° instead of 25° in the case of the antenna of "broadside" type. Consequently, the embodiment of FIG. 2*b* makes it possible to preserve sufficient quality of speech during lateral displacements of the talker with respect to the vertical plane of symmetry of the display screen.

A more detailed description of a preferred embodiment of the acoustic antenna of the "end-fire" type represented in FIG. 2*b* will now be given in conjunction with FIG. 4*a*.

Generally, it is indicated that the acoustic antenna according to the invention is subdivided into sub-antennas. In the embodiment of FIG. 4*a,* the acoustic antenna, of end-fire" type, is regarded as consisting of 9 successive microphones aligned on a support starting from the reference microphone $M_{ir}$ designated as $M_{i0}$, denoted S. The other successive microphones, in the direction of propagation of the incident sound wave ISW, are successively denoted $M_{i1}$ to $M_{i8}$. Thus as may be observed in FIG. 4*a,* the acoustic antenna according to the invention is subdivided into sub-antennas, each sub-antenna comprising microphones spaced apart on the straight support by a specified distance. Thus, a first sub-antenna is formed by the microphones $M_{i8}$ to $M_{i6}$ as well as by the microphones $M_{i4}$ and by the reference microphone $M_{ir}$, these microphones being linked to the same elementary summator $S_1$, a second elementary antenna formed by the microphones $M_{i6}$ to $M_{i4}$ as well as by the microphones $M_{i2}$ and $M_{ir}$ which are linked to the same elementary summator $S_2$, and a third elementary antenna is lastly formed by the microphones $M_{i4}$ to $M_{i1}$ and by the reference microphone $M_{ir}$ which are linked to the same third elementary summator $S_3$. Of course, the elementary summators $S_1$, $S_2$, $S_3$ are linked to a common summator, denoted Σ, delivering the speech signal by way for example of filters denoted $H_1$, $H_2$ and $H_3$.

According to a particularly advantageous characteristic of the acoustic antenna, which is the subject of the present invention, this antenna including means of analogue digital conversion of the sound signal delivered by each microphone $M_i$ by sampling at a given sampling frequency Fe, each microphone is distanced from the reference microphone $M_{ir}$ according to a distance law such that the delays in reception by each microphone of an incident sound wave ISW are multiples of the sampling period T=1/Fe.

Of course, the sound signal delivered by each microphone is then subjected to a corresponding delay by way of a delay circuit, denoted $D_0$ to $D_7$ in FIG. 4*a,* the microphone $M_{i8}$ not of course being subjected to any delay by reason of the maximum delay in receiving the sound signal originating from the talker, received by this latter microphone.

As represented in FIG. 4*a,* it is understood that the maximum delay is thus afforded by the delay circuit $D_0$ on the sound signal delivered by the reference microphone $M_{ir}$ or $M_{i0}$, the value of this delay decreasing successively for the delays afforded by the delay circuits $D_1$ to $D_7$ on the sound signals delivered successively by the corresponding microphones $M_{i1}$ to $M_{i7}$.

The distribution law for the microphones, reference microphones $M_{ir}$ and successive microphones $M_{i1}$ to $M_{i8}$, on the support S, this distribution law of course making it possible to generate successive delays to the signal of the incident sound wave ISW according to a specified delay law, and the corresponding delays afforded by each delay circuit $D_0$ to $D_7$, make it possible, at the level of each elementary summator $S_1$ to $S_3$, and lastly at the level of the global summator Σ, to provide for in-phase summation of the speech signals delivered by each microphone making up the acoustic antenna according to the invention, and thus to favour the incident sound wave ISW emanating from the talker in the reception radiation lobe mentioned previously in the description.

More particularly, it is indicated that the microphones $M_{ir}$ to $M_{i1}$, $M_{i8}$ are successively spaced apart on the straight support S by a distance which is in arithmetic progression with common difference a multiple of the smallest distance d separating the neighbouring microphone from the reference microphone. Thus, the distance separating two successive microphones is of the form:

$$x=k.d=k\ c/fe.$$

In the above relation, it is indicated that k is a positive integer, c represents the speed of propagation of the incident sound wave in the ambient medium and Fe represents the sampling frequency.

In the embodiment represented in FIG. 4*a,* and having regard to the indications above, it is indicated that the microphone $M_{i1}$ is distanced from the microphone $M_{ir}$, reference microphone, by the distance d, the microphones $M_{i2}$ to $M_{i4}$ are each distanced apart by the same distance d. The microphones $M_{i5}$ and $M_{i6}$ are distanced from the previous microphone $M_{i4}$ respectively $M_{i5}$ by a distance 2*d,* and finally, the microphones $M_{i7}$ and $M_{i8}$ are distanced from the previous microphone, respectively $M_{i6}$, $M_{i7}$ by a distance 4*d.* Consequently, and so as to provide a suitable delay for the sound signal delivered by each microphone, the delayer circuit $D_0$ makes it possible to apply a delay equal to the sum of the delays introduced by the maximum spacing between the reference microphone $M_{ir}$ and the endmost microphone $M_{i8}$, namely a delay corresponding to 16 sampling periods since in fact, the minimum elementary distance d separating two successive microphones corresponds to a time delay of propagation of the incident sound wave equal to a sampling period.

In the same way, the delay circuits $D_1$ to $D_7$ make it possible successively to generate a delay equal to 15T, 14T, 13T, 12T, 10T, 8T and 4T where T represents the value of the sampling period for the sound signal delivered by each microphone.

It is indicated that developments have been carried out for an acoustic antenna of the "end-fire" type such as described earlier and for a sampling frequency Fe=16 kHz. Under these conditions, the minimum distance between microphones is given by the relation:

$$d=\frac{c}{\mathrm{Fe}}=2.13\ \mathrm{cm}.$$

The abscissae of the 9 microphones installed on the support S were then as follows:

| | | | | | | | | |
|---|---|---|---|---|---|---|---|---|
| 0 | d | 2d | 3d | 4d | 6d | 8d | 22d | 16d |
| 0 cm | 2.13 cm | 4.26 cm | 6.39 cm | 8.52 cm | 12.78 cm | 17.04 cm | 25.56 cm | 34.08 cm |

The value of d can in a non-limiting arbitrary manner be chosen identical in the case of the "broadside" antenna and in the case of the "end-fire" antenna.

As regards a practical embodiment of the delay circuits $D_0$ to $D_7$, it is indicated that these delay circuits can be realized, either by analogue circuits when the delay is applied directly at the output of each relevant microphone, or, on the contrary, on the basis of digital circuits when the delay is applied even though the analogue digital conversion mentioned earlier in the description has already been carried out. The analogue or digital embodiment of the delay circuits poses no problem since the analogue digital conversion of the speech signals delivered by each microphone can be carried out in a conventional manner using analogue digital converters Δ, Σ. Corresponding embodiments will not be described in detail in the present description since they correspond to techniques which are known to those skilled in the art. These analogue digital converters can be associated with the delay circuits or preferably with the output of the microphones, as mentioned in FIG. 4*a* with the reference +ADC.

The practical mechanical realization of the acoustic antenna, which is the subject of the present invention, as represented in FIG. 2*b* or 4*a,* has by contrast particular features allowing intricate implementation of the acoustic antenna according to the invention.

In general, it is indicated that the support S is made from a rigid, acoustically non-disturbing support.

More particularly, as represented in FIG. 4*b,* the support S can consist of a rigid rod forming the straight support and of a plurality of microphone supports, each microphone support being formed by a substantially symmetric double structural element mechanical piece.

In FIG. 4*b,* the microphone supports bear in a non-limiting manner the reference $P_0$ to $P_4$ for example. Each microphone support $P_0$ to $P_4$ is formed by a substantially symmetric double structural element mechanical piece, a first element of which is intended to provide for the placement of the corresponding microphone support on the rigid rod S, whereas a second element is intended to receive and provide for the retention of a corresponding microphone. In FIG. 4*b,* the substantially symmetric double structural element mechanical piece has the shape of an eight, one of the loops of which is threaded onto the support S so as to provide for the placement of the microphone support on the aforesaid rigid rod S, and the second loop of which constituting the second element is intended to receive and provide for the retention of a microphone. Mechanical holding of the microphones on the supports is guaranteed by a force-fit, for example, or by a binding screw, any risk of positional shifting of the microphones then being eliminated.

Represented in FIG. 4*c* is a sectional view along the longitudinal sectional plane Q of FIG. 4*b.*

As represented in the aforesaid FIG. 4*c,* it is indicated that the rod forming the support S is hollow and includes a central bore. The rod forming the support S is furthermore furnished on one of the generator lines of its lateral surface, with a plurality of through holes communicating between the central bore and the outside part of the rod, thus allowing passage of the connection wires fc of each microphone into the central bore. Lastly, it is indicated that the double structural element mechanical pieces constituting the microphone supports advantageously have the smallest possible thickness dimension in the longitudinal direction y'y of the support S, so as not to disturb the acoustic characteristics of each microphone.

Furthermore, as represented in FIG. 4*a,* the acoustic antenna, which is the subject of the present invention, can advantageously include a gang of switches, denoted $I_0$ to $I_8$, a switch of this gang of switches being placed in series link with the connection for example to the corresponding delayer circuits $D_0$ to $D_7$ or to the elementary summator $S_1$. Each switch $I_0$ to $I_8$ makes it possible to provide for the connection or non-connection of at least one microphone to the summator circuit Σ by way of the elementary summator circuits. This mode of operation then makes it possible to modify the reception pattern of the acoustic antenna according to the invention as a function of the configuration of connection or non-connection of the microphones of the antenna. In fact, the swapover to a different antenna pattern can also be carried out by switching at the level of the output signals delivered by the sub-antennas, that is to say by the summators $S_1$ to $S_3$. For this purpose, specific switches $IS_1$ to $IS_3$ can be provided, such as represented in FIG. 4*a*. For example, a wider lobe, for the case in which several people are present in front of the workstation, can be obtained by replacing the sum at the output of the summator Σ by the signal delivered by the summator $S_3$, that is to say by the sub-antenna of smallest size. The transfer function of the filter associated with the aforesaid sub-antenna is modified as a consequence. With this assumption, the switch $IS_3$ is closed and the switches $IS_1$ and $IS_2$ open, the signal delivered by the summator $S_3$ alone being transmitted to the summator Σ. This mode of operation appears of interest in respect of the "broadside" antenna in particular, such as represented in FIG. 3*b,* the swapover being carried out on the basis of the switches $I_0$ to $I_8$ and/or $IS_1$ to $IS_4$ for example.

In general, as regards the implementation of the straight antenna which is the subject of the present invention, it is indicated, both as regards the antennas of "broadside" type and the antennas of "end-fire" type, that there is a minimum condition relating to the distance between microphones such as to avoid the disturbance phenomenon known as "aliasing".

For the antennas of "broadside" type, the condition is $d<\lambda$ where λ denotes the wavelength of the incident sound wave.

For an antenna of "end-fire" type, this condition is expressed as $d<\pi/2$.

Consequently, it follows that an antenna of "end-fire" type is of smaller size than an antenna of "broadside" type, this naturally making it possible to obtain better compactness of the antenna thus produced.

In both cases, once the signals delivered by the microphones have been digitized, the elementary delay allowed is equal to the sampling period mentioned earlier in the description. This elementary delay proves however to be insufficiently accurate to provide for the pointing of the antenna in the direction of the talker. According to an advantageous characteristic of the acoustic antennas, which are the subject of the present invention, a way of producing such delays consists in arranging these microphones in such a way that the delays are multiples of the aforesaid sampling period. It is then no longer necessary, in order to perform the pointing in the direction of the talker, to employ interpolation techniques which are expensive in terms of computation time.

Figure 5A:
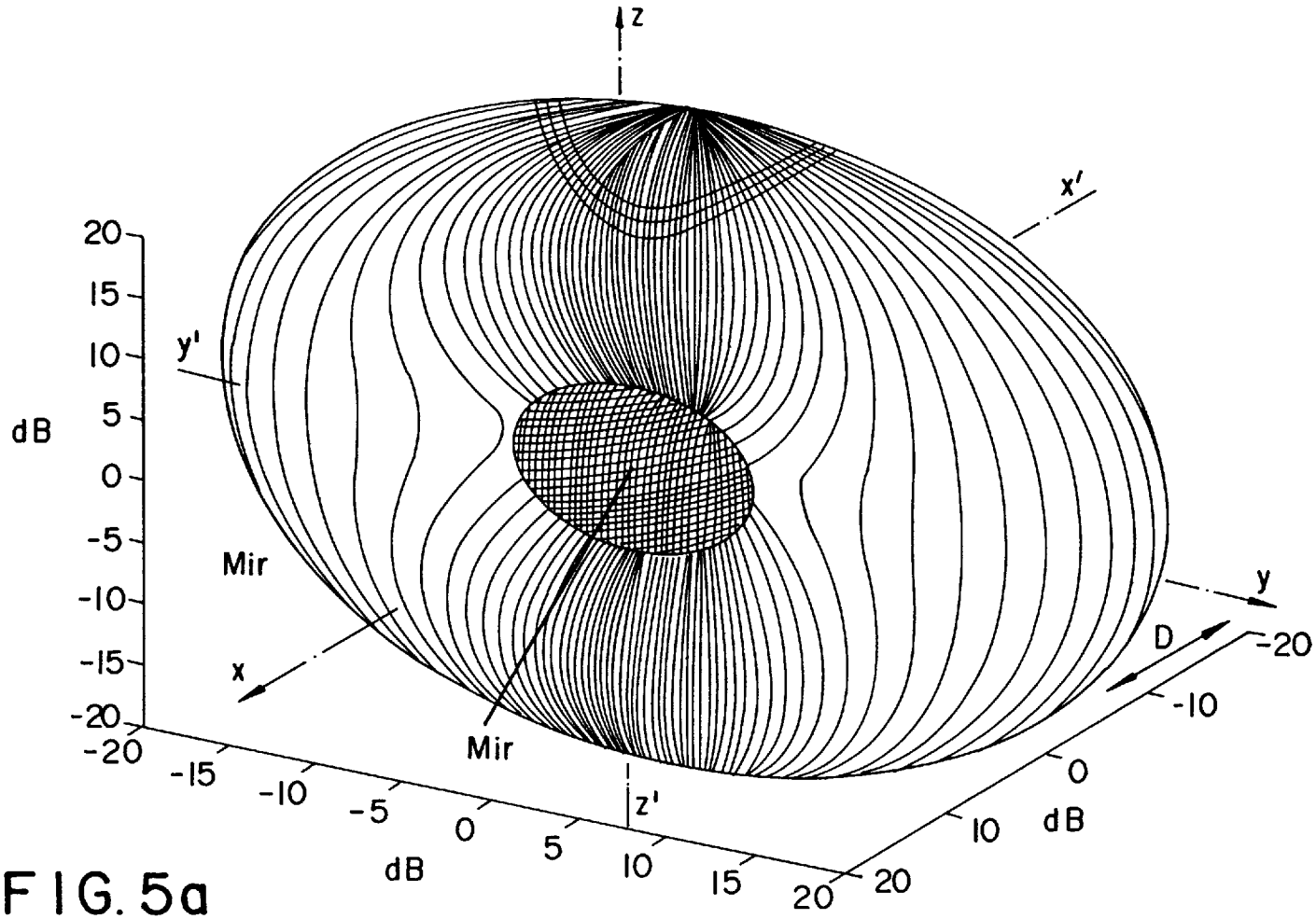
Figure 5B:
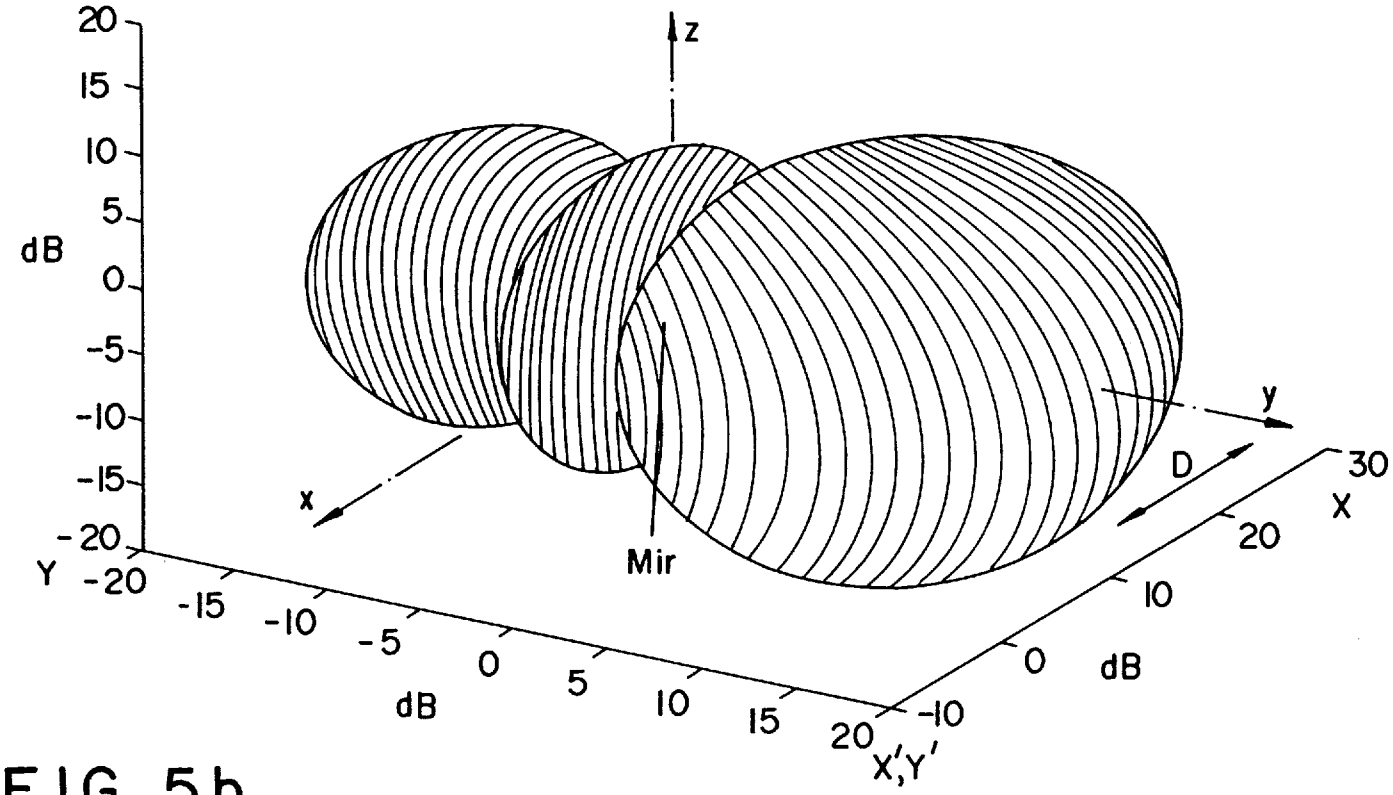

Represented in FIGS. 5*a* to 5*b* are various reception directivity patterns for an antenna of "broadside" type, FIG. 5*a,* implementing omnidirectional microphones, 9 microphones as represented in FIG. 2*a.* The directivity pattern thus represented, the microphones being aligned with the axis of symmetry x'x, have, as mentioned earlier, substantially the form of a vertical disc, but, more particularly, that of a torus, at least in respect of the main lobe such as represented in FIG. 5*a.* It is however indicated that, depending on the grouping of the microphones and their spacing, the directivity pattern also comprises degenerate lateral lobes extending in the direction x'x, these lateral lobes, although present, not however being represented in a significant manner in FIG. 5*a,* being masked in the chosen representation.

Represented on the contrary in FIG. 5*b* is the directivity pattern of an antenna of "end-fire" type also including 9 microphones placed as represented in FIG. 2*b.* The microphones are of course placed and aligned in the direction y'y such as represented in FIG. 5*b,* the directions x'x, y'y and z'z of FIG. 5*a* and of FIG. 5*b* being identical so as to facilitate comparison. In the case of FIG. 5*a* and of FIG. 5*b,* it is indicated that the reference microphone $M_{ir}$ is placed in the vicinity of the origin of the axes OXYZ, the corresponding directivity patterns being those produced in the far field.

In FIG. 5*b* it may be noted that the directivity pattern exhibits substantially the shape of a cylinder for which the aperture of the main lobe is much greater than that of the aperture of the main lobe of the directivity pattern of the "broadside" antenna represented in FIG. 5*a.* In both cases, the talker lies, with respect to the reference microphone $M_{ir}$, in the direction y'y.

Figure 5C:
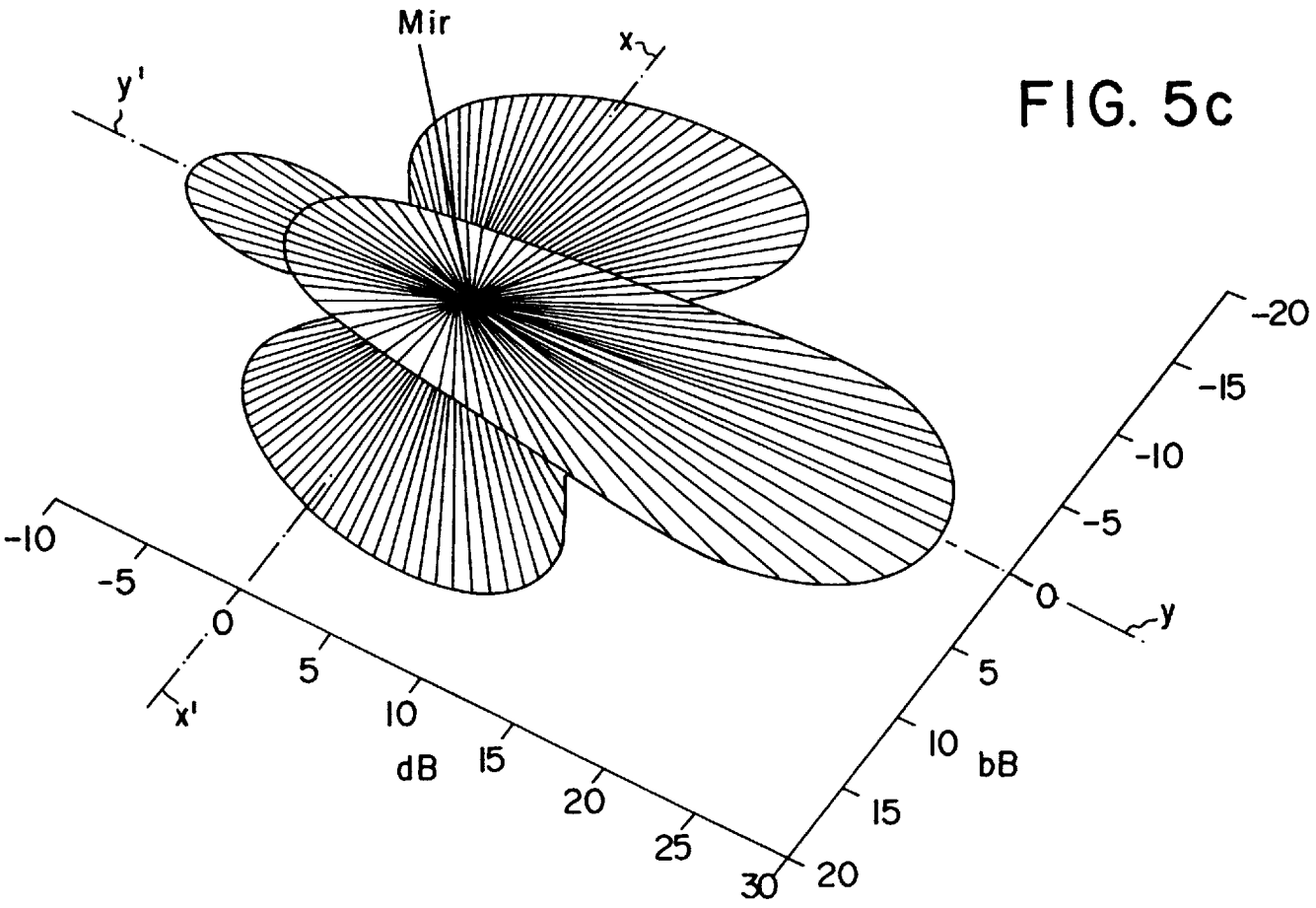
Figure 5D:
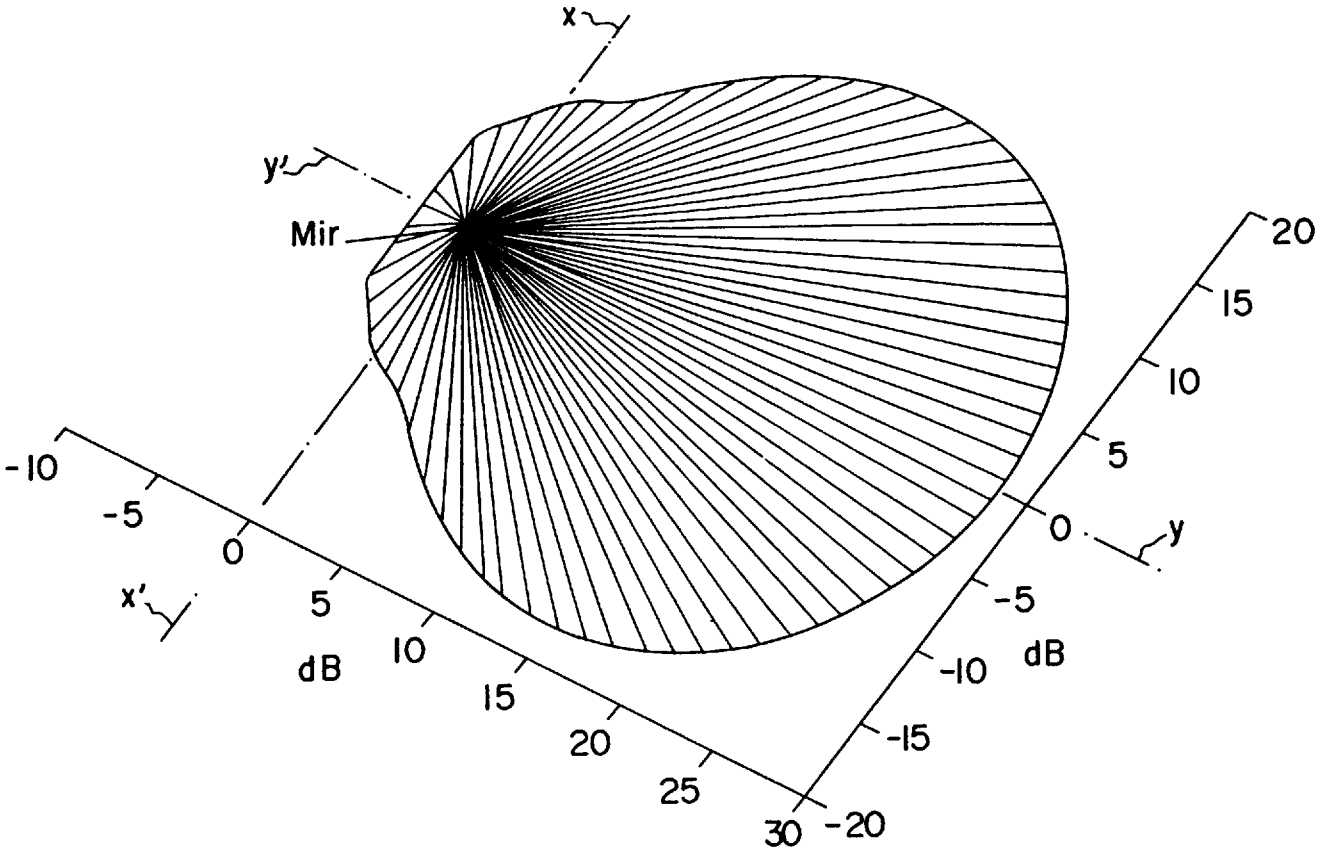

Represented, viewed from above, in FIGS. 5*c* and 5*d* is a view from above respectively of FIG. 5*a* in which the lateral lobes of the directivity pattern are visible, and of FIG. 5*b* in which the rear lobe has been eliminated through judicious choice of the spacings of the microphones and of the delays which are applied to the speech signals generated by them. The microphones used in this case are unidirectional.

Represented in FIG. 5*d* is the directivity pattern of an "end-fire" antenna for which the microphones are distributed in the direction y'y. Starting from an antenna of "broadside" type, for which the microphones are distributed in the direction x'x and whose directivity pattern is represented in FIG. 5*c,* it is possible, in accordance with a noteworthy aspect of the acoustic antenna which is the subject of the present invention, to obtain a directivity pattern, such as represented in FIG. 5*d,* similar to that of an "end-fire" antenna but subjected to a π/2 rotation through the introduction of delays to the signals delivered by the microphones, the axis of symmetry of the directivity pattern then being the axis x'x.

In both cases, the spatial selectivity of the acoustic antennas implemented is related to the ratio of their size to the relevant wavelength. In the low-frequency region, the antennas implemented provide little reduction of the effect of their acoustic environment.

In the case of the implementation of an antenna of "broadside" type such as represented in FIG. 2*a,* the addition of two lateral microphones, as represented in FIG. 3, enable this defect to be partly alleviated.

However, as regards the acoustic antenna of "end-fire" type, raising the selectivity at low frequency requires an appreciable increase in the size of the antenna if of course it is desired to preserve the same structure. In the case of the acoustic antenna of "end-fire" type in which the digitizing of all the speech signals delivered by each microphone is carried out, it is possible to implement very sophisticated speech signal processing techniques capable of improving the rejection of noise and of room effect. These processing techniques can consist of Wiener or Ephraim and Malah filtering techniques.

In the same way and in particular in the case of the antenna of "end-fire" type, it is possible to modify the shape of the main lobe of the directivity pattern, especially in the case where several people situated in front of the computer work terminal wish to take part in communication, especially in the case of an application to video conferencing. Swapover can be performed on one sub-antenna. Furthermore, the improvement in quality afforded by the acoustic antenna, which is the subject of the present invention, of either type is also significant in respect of a distant talker.

In such a case, the switches mentioned earlier can then be used in such a way as to switch on demand the antenna of "end-fire" type or, as the case may be, the antenna of "broadside" type to a favoured microphone, the reference microphone $M_{ir}$, all the other microphones being for example disconnected.

Some spatial selectivity can however be preserved by switching to a specified sub-antenna of smaller size.

As compared with a single microphone, the acoustic antenna, which is the subject of the present invention, whether it be in its "broadside" or "end-fire" type embodiment, improves control of the echo since this type of antenna increases, because of its spatial selectivity, the decoupling between the loudspeaker and the sound capture system.

However, when an echo canceller is used, the reduction in the coupling is greater in the high frequencies than in the low-frequency range, and it is therefore necessary to provide an adaptation of the parameters of the echo canceller as a consequence.

In the same way, in the case of the modification of the main lobe of the reception directivity pattern or in the case of the orientation of the latter, it is necessary to adapt the operation of the echo canceller to these modifications. This adaptation is necessary, especially in video conferencing applications or even in the case of personal computer terminal applications.

Furthermore, it is indicated that the obtaining of a reception directivity pattern approaching that of an antenna of "end-fire" type can be realized on the basis of an antenna of "broadside" type, except as regards rejection of the rear waves, as mentioned earlier in conjunction with FIGS. 5*c* and 5*d*. Thus, it is understood that it is possible, in accordance with a particularly noteworthy aspect of the acoustic antenna, which is the subject of the present invention, to go from the antenna of "broadside" type such as represented in FIGS. 3*a*, 3*b*, to the antenna of "end-fire" type such as represented in FIGS. 4*a*, 4*b*, via a geometric adaptation or transformation consisting:

- in folding up the "broadside" antenna 180° about the reference microphone $M_{ir}$, $M_{i0}$;
- in shifting the coincident microphones by the distance separating them from the adjacent microphone, before fold-up, the microphones being of course reoriented by rotation towards the direction of the incident sound wave ISW.

Of course, the inverse transformation makes it possible to go from the antenna of "end-fire" type to the antenna of "broadside" type.

The effect of the aforesaid transformation, the phase propagation delay of the incident sound wave ISW being compensated, in the antenna of "end-fire" type, by the appropriate delay circuits, is to produce reception directivity patterns approaching in both cases, under the conditions described earlier in the description, with enhanced facility of integration, respectively a much more discreet appearance.

Lastly, electronic orientation of the main lobe of the antenna can be carried out by virtue of the implementation of devices for interpolating the speech signals delivered by each microphone, such a main lobe electronic orientation function being optimizable only in the case in which a system for pinpointing the talker is used. Such a main lobe electronic orientation function finds a favoured application in the context of the use of and application to video conferencing.

We claim:

1. An acoustic antenna for computer workstation including a display screen and comprising a plurality of microphones connected to a summator circuit, said microphones being distributed in a layout so as to form at least one substantially straight line and each of said microphones being spaced, with respect to a reference microphone placed in the vicinity of the vertical axis of symmetry of the screen, according to a specified law, wherein the said layout comprises:

- a plurality of microphones distributed over a first line substantially horizontal and placed at the upper part of said screen,
- at least one microphone placed on a second and a third line respectively, said second and third lines being placed perpendicularly to the ends of said first line, said microphones of the first, second and third lines being arranged in a plane, said layout exhibiting a substantially cylindrical directivity pattern whose axis of revolution is formed by said at least one straight line.

2. The antenna according to claim 1, wherein said microphones are arranged on an antenna support arranged in the upper part of the filter of the display screen, of this screen or of the monitor which includes this screen.

3. The antenna according to claim 1, wherein said antenna furthermore includes a gang of switches making it possible to provide for the connection of at least one microphone or one sub-antenna to said summator circuit, the transfer function of a filter associated with this sub-antenna being modified, thereby allowing to modify the reception pattern of said antenna as a function of the configuration of connection or non-connection of said microphones of said antenna.

4. An acoustic antenna for computer workstation including a display screen and comprising a plurality of microphones connected to a summator circuit, said microphones being distributed in a layout so as to form at least one substantially straight line and each of said microphones being spaced, with respect to a reference microphone placed in the vicinity of the vertical axis of symmetry of the screen, according to a specified law, wherein said layout comprises a plurality of microphones arranged on a straight support, said straight support being placed substantially in the vertical plane of symmetry of said display screen, said microphones being spaced with respect to said reference microphone according to a specified law so as to form an antenna of the "end-fire" type, said antenna being subdivided into sub-antennas, each sub-antenna comprising microphones spaced apart on the straight support by a specified distance, said layout exhibiting thus a substantially cylindrical directivity pattern whose axis of revolution is formed by said at least one straight line.

5. The antenna according to claim 4, wherein said antenna including means of analogue/digital conversion of the sound signal delivered by each microphone by sampling at a given sampling frequency Fe, each microphone is distanced from said reference microphone according to a distance law such that the delays in reception by each microphone of an incident sound wave are multiples of the sampling period corresponding to said sampling frequency.

6. The antenna according to claim 5, wherein said microphones are successively spaced apart on said straight support by a distance which is in arithmetic progression with common difference a multiple of the smallest distance separating the neighbouring microphone from the reference microphone, the distance separating two successive microphones being of the form:

$$x=kd=k\ c/Fe$$

with k an integer, c denoting the speed of propagation of the incident sound wave.

7. An antenna for computer workstation including a display screen and comprising a plurality of microphones connected to a summator circuit, said microphones being distributed in a layout so as to form at least one substantially straight line and each of said microphones being spaced, with respect to a reference microphone placed in the vicinity of the vertical axis of symmetry of the screen, according to a specified law, wherein said layout comprises a plurality of microphones arranged on a straight support, said straight support being placed substantially in the vertical plane of symmetry of said display screen, said microphones being spaced with respect to said reference microphone according to a specified law so as to form an antenna of the "end-fire" type, said antenna comprising a rigid rod forming said straight support together with a plurality of microphone supports, each microphone support being formed by a substantially symmetric double structural element mechanical piece, a first element being intended to provide for the placement of said microphone support on said rigid rod, and a second element being intended to receive and provide for the retention of a microphone, said antenna being subdivided into sub-antennas, each sub-antenna comprising microphones spaced apart on said straight support by a specified distance, said layout exhibiting thus a substantially cylindrical directivity pattern whose axis of revolution is formed by said at least one straight line.

8. The antenna according to claim 7, wherein said rod is hollow and includes a central bore, said rod furthermore being furnished on one of the generator lines of its lateral surface with a plurality of through holes communicating between said central bore and the outside part of the rod, allowing thus passage of the connection wires of each microphone into said central bore.

9. The antenna according to claim 7, wherein said antenna furthermore includes a gang of switches making it possible to provide for the connection of at least one microphone or one sub-antenna to said summator circuit, the transfer function of a filter associated with this sub-antenna being modified, thereby allowing to modify the reception pattern of said antenna as a function of the configuration of connection or non-connection of said microphones of said antenna.

* * * * *